United States Patent [19]

Ikeura et al.

[11] 4,168,679

[45] Sep. 25, 1979

[54] ELECTRICALLY THROTTLED FUEL CONTROL SYSTEM FOR INTERNAL COMBUSTION ENGINES

[75] Inventors: Kenji Ikeura, Yokosuka; Akihiro Ohnishi, Koshigaya, both of Japan

[73] Assignee: Nissan Motor Company, Limited, Japan

[21] Appl. No.: 829,977

[22] Filed: Sep. 1, 1977

[30] Foreign Application Priority Data

Sep. 3, 1976 [JP] Japan ..... 51-105973

[51] Int. Cl.[2] ..... F02P 5/04; F02B 3/00

[52] U.S. Cl. ..... 123/32 ED; 123/32 EE; 123/117 R

[58] Field of Search ..... 123/32 ED, 32 EE, 32 EB, 123/32 EA, 179 EC

[56] References Cited

U.S. PATENT DOCUMENTS

| | | | |
|---|---|---|---|
| 3,873,855 | 3/1975 | Reddy | 123/32 ED |
| 3,908,614 | 9/1975 | Ironside et al. | 123/32 ED |
| 3,931,808 | 1/1976 | Rachel | 123/32 EE |
| 3,948,237 | 4/1976 | Williams et al. | 123/32 ED |
| 3,973,529 | 8/1976 | Wessel et al. | 123/32 EE |
| 4,010,717 | 3/1977 | Daplin | 123/32 ED |
| 4,022,170 | 5/1977 | Crall et al. | 123/32 ED |
| 4,027,477 | 6/1977 | Sherey | 123/32 EE |
| 4,047,507 | 9/1977 | Noguchi et al. | 123/32 EB |
| 4,058,089 | 11/1977 | Schmidt et al. | 123/32 ED |
| 4,066,054 | 1/1978 | Caron et al. | 123/32 ED |

FOREIGN PATENT DOCUMENTS

| | | | |
|---|---|---|---|
| 932431 | 8/1973 | Canada | 123/32 ED |
| 2520751 | 2/1976 | Fed. Rep. of Germany | 123/32 ED |
| 2638504 | 3/1977 | Fed. Rep. of Germany | 123/32 ED |
| 1440347 | 6/1976 | United Kingdom | 123/32 ED |

*Primary Examiner*—Charles J. Myhre
*Assistant Examiner*—R. A. Nelli
*Attorney, Agent, or Firm*—Lane, Aitken & Ziems

[57] ABSTRACT

A fuel control system for internal combustion engines includes a fuel injection control unit responsive to the amount of depression of an accelerator pedal to determine the fuel quantity and an air intake control unit which determines the amount of air to be mixed therewith in response to the determined fuel quantity to correspondingly operate a throttle valve. Fuel and air are supplied to the engine such that they reach the cylinder simultaneously.

7 Claims, 10 Drawing Figures

TO OTHER INJECTORS
PULSE WIDTH TO VOLTAGE CONVERTER
AIR INTAKE CONTROL UNIT
POWER STAGE
AIR
ACTUATOR
ELECTRONIC FUEL INJECTION CONTROL UNIT
OR
ENG. TEMP.
MANIFOLD VAC.
ANGULAR POS. DET.
PULSE INT'VAL TO VOLTAGE CONVERTER
INTEGRATOR
MONO
INTERNAL COMBUSTION ENGINE
DIST
EXHAUST
10
11
12
13
14
15
16
17
18
20
21
22
23
24
25
26

ELECTRICALLY THROTTLED FUEL CONTROL SYSTEM FOR INTERNAL COMBUSTION ENGINES

FIELD OF THE INVENTION

The present invention relates generally to fuel control systems, and specifically to a fuel control system for internal combustion engines in which a throttle valve is electronically controlled with a signal derived from the amount of fuel which has been determined in response to the amount of acceleration.

BACKGROUND OF THE INVENTION

In conventional fuel injection control systems, a throttle valve is mechanically linked to an accelerator pedal and the amount of fuel needed for each engine revolution is computed by a control unit in response to sensed engine operating parameters including the throttle position data. Since the throttle valve is operated prior to the computation of fuel quantity for that particular throttle position, the air inducted in response to the throttle operation may reach a combustion chamber of the engine prior to the fuel injected in response to the throttle operation. This results in a shortage of fuel when the engine is rapidly accelerated.

SUMMARY OF THE INVENTION

An object of the invention is to provide a fuel control system for internal combustion engines which eliminates the shortage of fuel at the time of rapid engine acceleration by first determining fuel quantity in response to the depression of an accelerator pedal and then operating a throttle valve with an electrical signal derived from the determined fuel quantity.

In one embodiment of the invention, an electronic fuel injection control unit is provided to derive a signal from the amount of depression of the accelerator pedal and which signal is applied to fuel injectors. To give a mixture of air and fuel in a predetermined ratio, there is a correlation between a particular throttle opening and a set of particular engine speed and power. A detector is provided for sensing the speed of the engine. In a preferred embodiment, correlating digital information is stored in a memory matrix. The signals from the engine speed detector and from the fuel injection control unit are converted into digital signals which are used to address the memory location of the matrix to retrieve the stored information therefrom, the retrieved signal being converted into an analog signal which is used to drive the throttle valve.

Since the fuel quantity is determined prior to the throttle movement, fuel and air can be supplied such that they reach the engine cylinder at the same instant of time. According to a further feature of the invention, since the amount of inducted fuel is determined in response to the previously determined fuel quantity, air fuel ratios can be maintained constantly at a desired value regardless of varying engine loads.

BRIEF DESCRIPTION OF THE DRAWINGS

The invention will be further described in detail with reference to the accompanying drawings, in which.

DESCRIPTION OF THE PREFERRED EMBODIMENTS

Figure 1:
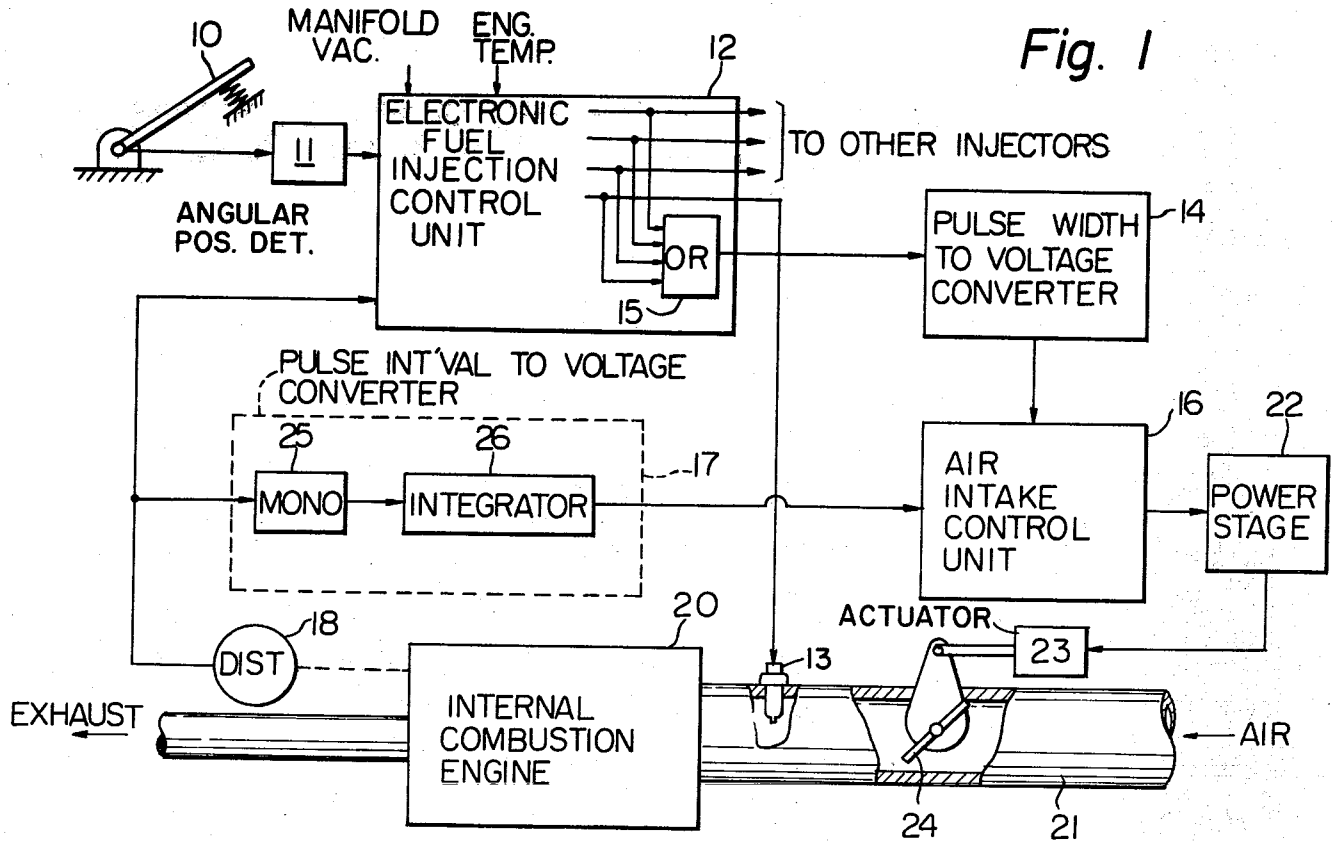
FIG. 1 is a functional block diagram of an embodiment of the present invention.

In FIG. 1 of the drawings, an angular position detector 11 is operatively coupled to the accelerator pedal 10 to generate a voltage signal representative of the angular position of the pedal 10 with respect to a reference point. This voltage signal is applied to an electronic fuel injection control unit 12 of conventional design. Signals indicating other engine parameters such as engine temperature, manifold vacuum and distributor ignition pulses, etc. are also applied to the control unit 12 where the input signals are processed to compute the width of injection pulses supplied to an injector 13 and to the other injectors (not shown). The injection pulses are also applied through OR gate 15 to a pulse width to voltage converter 14 where the width of the injection pulse is converted into a corresponding voltage signal. This voltage signal represents the output power of the engine 20 and is applied to an air intake control unit 16. A pulse-interval to voltage converter 17 is provided to convert the interval between successive ignition pulses from an ignition distributor 18 to derive a voltage signal representing the speed of the engine 20, which voltage signal is applied to the air intake control unit 16 where the input signals are processed to compute the amount of air to be inducted through an air intake passage 21. The output from the control unit 16 is amplified by a power stage 22 and applied to an actuator 23 which is operatively connected to a throttle valve 24.

In deriving the engine speed representative signal, the pulse-interval to voltage converter 17 includes a monostable multivibrator 25 coupled to the distributor 18 to shape the input waveform into a constant width pulse which is integrated by an integrator 26. The output from the integrator 26 increases with the repetition rate of the ignition pulse so that engine speed is represented by the integrator output.

Figure 2:
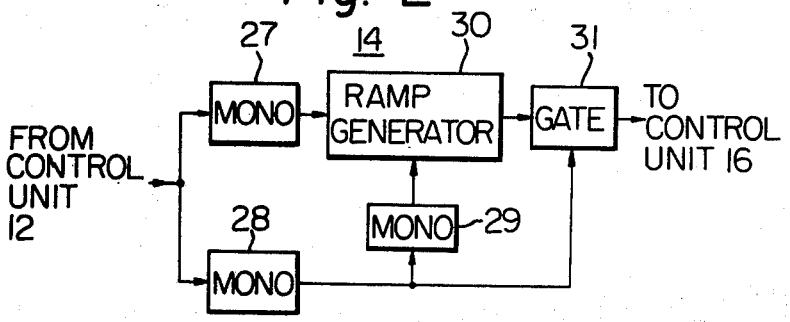
FIG. 2 is a detail of the pulse width to voltage converter of the embodiment of FIG. 1.
Figure 3:
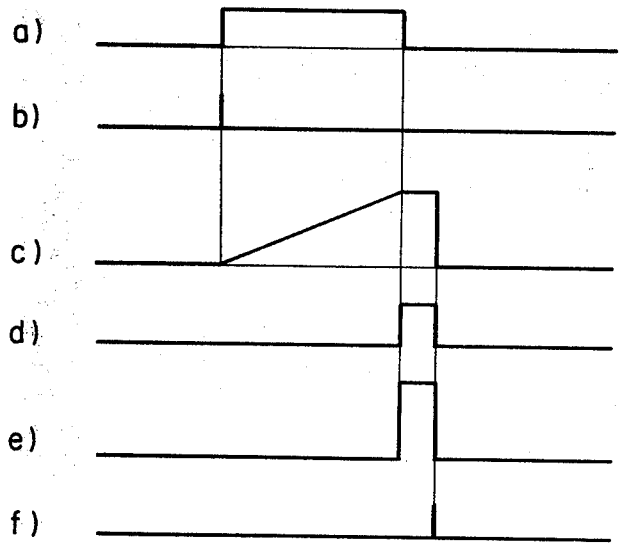
FIG. 3 is a series of waveforms useful for describing the operation of the circuit of FIG. 2.

As illustrated in FIG. 2, the pulse-width to voltage converter 14 includes monostable multivibrators 27, 28 and 29, a ramp generator 30 and a transmission gate 31. The input injection pulse (FIG. 3*a*) from the control unit 12 is applied to the monostable multivibrator 27 which detects the leading edge (FIG. 3*b*) of the applied pulse to trigger the ramp generator 30, the output of which increases with time until a maximum value is reached at the trailing edge of the injection pulse and remains there until it is reset by the monostable 29 (FIG. 3*c*). The monostable 28 detects the trailing edge of the injection pulse and produces a pulse (FIG. 3*d*) of a period during which the gate 31 is held open to produce an output of which the amplitude represents the pulse width of the injection pulse. The trailing edge of the output of the monostable 28 is detected by the monostable 29 (FIG. 3*f*) so that the ramp generator 30 is reset simultaneously with the closure of the gate 31.

Figure 4:
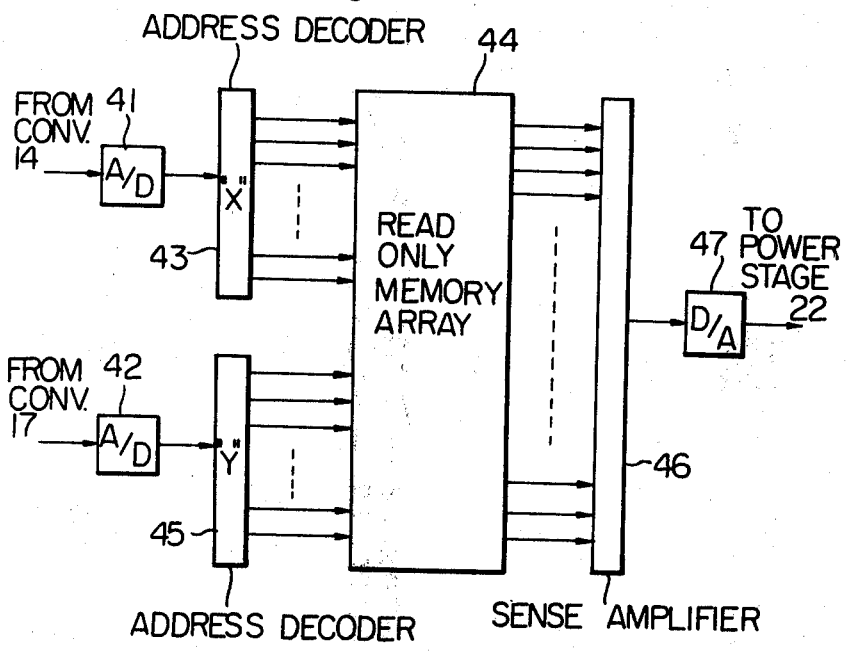
FIG. 4 is a functional block diagram of the air intake control unit of FIG. 1.
Figure 5:
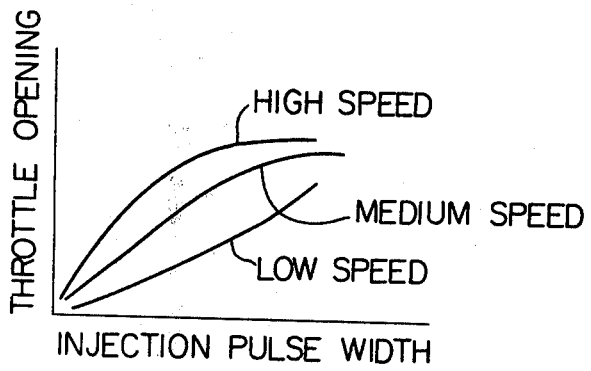
FIG. 5 is a graphic representation of the relationships between throttle opening and injection pulse width representing engine power with engine speeds as parameters.

FIG. 4 illustrates an example of the air intake control unit 16 wherein the engine power representative signal from the converter 14 is applied to an analog-digital converter 41 where the input signal is converted into a digital code which is applied to an "X" address decoder 43 where the digital code is translated into a signal indicating an "X" address bus of a read-only memory array or matrix 44. The engine speed indicative signal from the converter 17 is converted into a digital code by an analog-digital converter 42 and transferred to a "Y" address decoder 45 where the digital code is translated into a "Y" address bus of the memory array 44 so that an intersection of the array is determined. FIG. 5 illustrates curves each showing the relationship between throttle opening and injection pulse width, or engine output power for a particular engine speed. These curves are determined from analysis that for a particular fuel quantity the amount of air to be mixed therewith will give a desired mixture ratio, or stoichiometry so that the air-fuel ratio can be maintained at stoichiometry at all times regardless of the varying engine loads. At each intersection of the memory matrix there is stored digital information representing a throttle opening for a set of a particular engine speed and a particular engine power as plotted in FIG. 5. Therefore, given a set of input voltages from the converters 14 and 17, the read-only memory 44 provides a digital output indicating a corresponding throttle opening, which output is sensed by a sense amplifier 46 and converted into an analog signal by a digital-analog converter 47 which applies its output to the actuator 23 via power stage 22. It is appreciated that in response to the actuation of the accelerator pedal the amount of fuel is determined prior to the determination of the amount of air to be mixed therewith. The fuel and air so determined are supplied to the engine cylinder such that they reach the combustion chamber at the same time.

Figure 6:
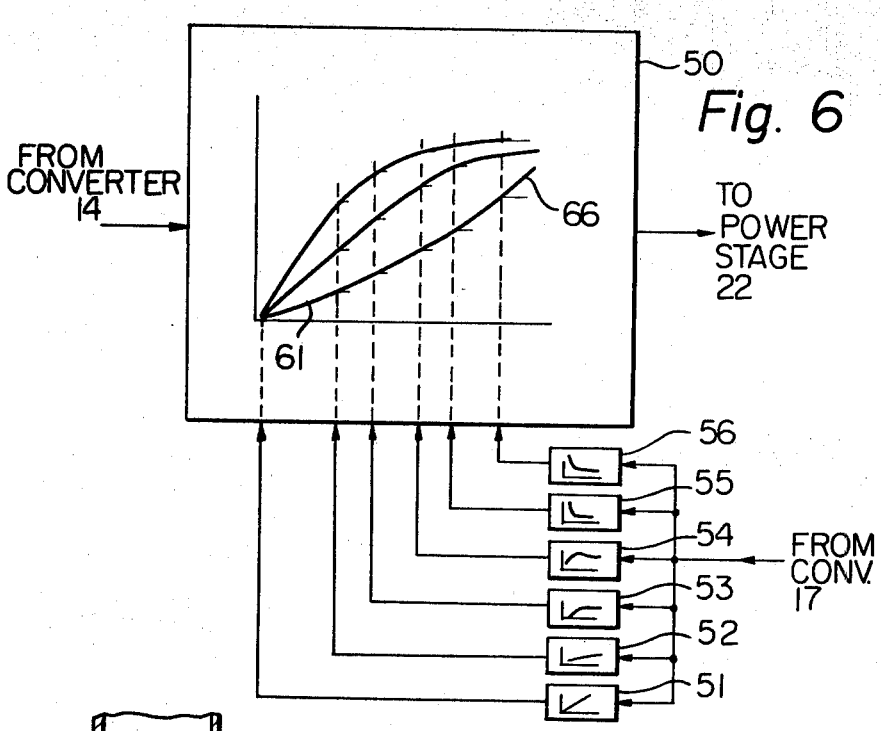
FIG. 6 is an alternative embodiment of the air intake control unit of FIG. 1.

An alternative arrangement of intercorrelating the throttle opening with the aforesaid engine operating parameters is shown in FIG. 6 in which a variable diode function generator 50 is provided to receive an engine power representative signal from the converter 17. The function generator 50 includes a plurality of diodes and resistors which are coupled to provide piecemeal approximation of the curves of FIG. 5 with a plurality of line segments. The detail of the variable diode function generator is described in Operational Amplifiers, Design and applications, Tobey, Graeme and Huelsman, published by McGraw-Hill, pp. 253–256. The diodes and resistors of the function generator 50 are connected to the outputs of function generators 51 to 56 such that the slope of each line segment is varied with a voltage supplied from the corresponding function generator. Each of the function generators 51 to 56 has a fixed amplitude characteristic which is responsive to the engine speed indicating signal from the converter 17 to generate a voltage signal that varies the slope of the corresponding line segment as shown in FIG. 6. For example, the function generator 51 generates a voltage which increases substantially linearly with the output from the converter 17, and the line segment 61 increases its slope in proportion to the engine speed. On the other hand, the function generator 56 provides an output which amplitude decreases nonlinearly with engine speed so that the slope of line segment 66 decreases as engine speed increases.

Figure 7:
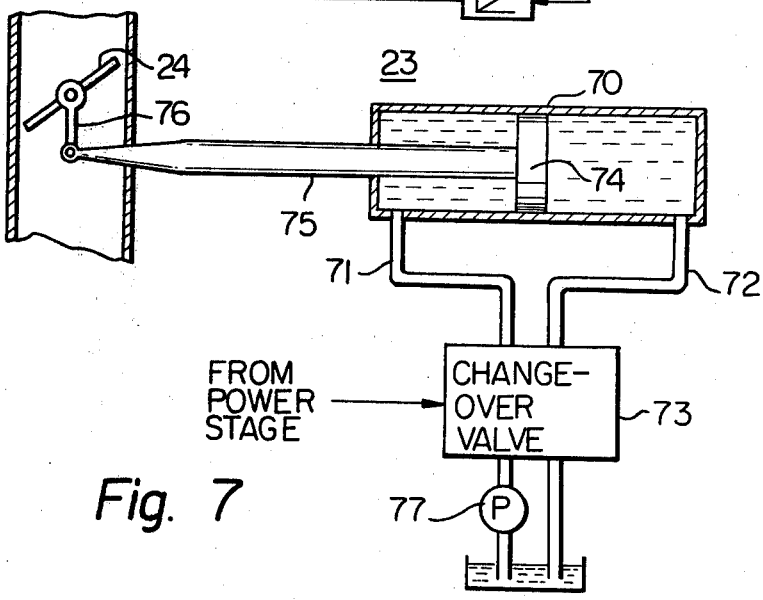
FIG. 7 is a detail of the actuator of FIG. 1.

In FIG. 7 an example of the actuator 23 is illustrated. In this example the actuator comprises a hydraulic cylinder 70 communicated through pipes 71 and 72 to a conventional changeover electromagnetic valve 73. A piston head 74 is slidably disposed in the cylinder housing 70 and connected by a rod 75 and a linkage 76 to the throttle valve 24. The changeover valve 73 directs fluidic flow from a pump 77 to one of the pipes 71 and 72 depending on the magnitude of the control signal from the power stage 22 and continuously varies the amount of fluid supplied to the cylinder 70. In response to the direction and amount of fluid supplied to the cylinder, the piston head 74 moves in the axial direction to vary the angle of the throttle valve 24.

Figure 8:
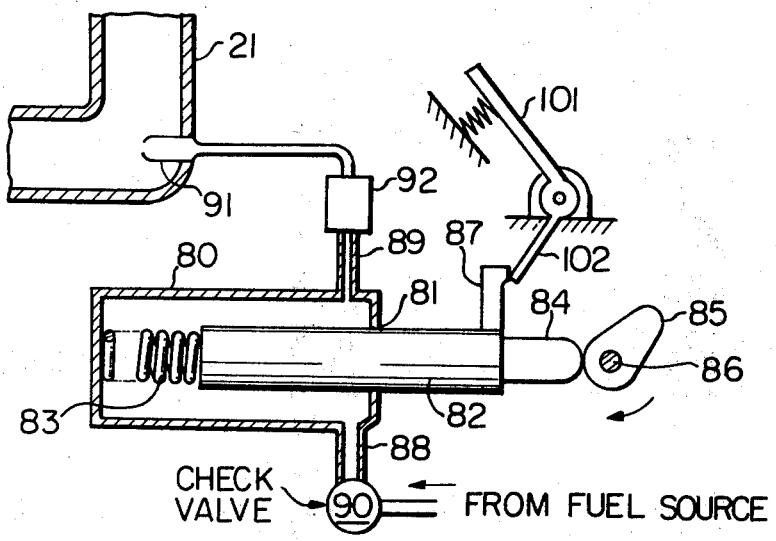
FIG. 8 is an alternative embodiment of the fuel control unit of FIG. 1.

FIG. 8 illustrates a mechanical fuel control unit which includes a cylinder 80 having an open end 81 through which a piston rod 82 slidably extends into the cylinder interior with the forward end being terminated by a coil spring 83. The piston rod 82 is formed at its rearward end to define an extension or cam follower 84 which engages a cam 85 mounted on the engine crankshaft 86. The piston 82 is formed with a lug 87 at the rearward end thereof. The accelerator pedal 101 is provided with a stop member 102 which determines the amount of stroke of the piston. The cylinder 80 is formed with an inlet port 88 connected to a source of fuel (not shown) through a check valve 90 and an outlet port 89 connected to a fuel nozzle 91. Between the nozzle 91 and the outlet port 89 is disposed a flow detecting means 92 which detects fuel flow to the nozzle 91.

In operation, the rotation of crankshaft 86 causes the piston rod 82 to move in opposition to the spring 83 to compress the fuel in the cylinder 80 so that fuel is injected into the intake pipe 21 through the nozzle 91 and then backward by the action of the spring 83 until the lug 87 engages the stop 102 to allow an amount of fuel to enter the cylinder 80. The check valve 90 prevents fuel in the cylinder 80 from flowing back toward the fuel source when the cylinder interior is compressed by the piston. As the accelerator pedal 101 is depressed to give an increased engine power, the stop member 102 rotates counterclockwise to allow the piston rod 82 to return to a position close to the cam 85 so that an additional amount of fuel may be supplied to the cylinder housing 80.

Figure 9:
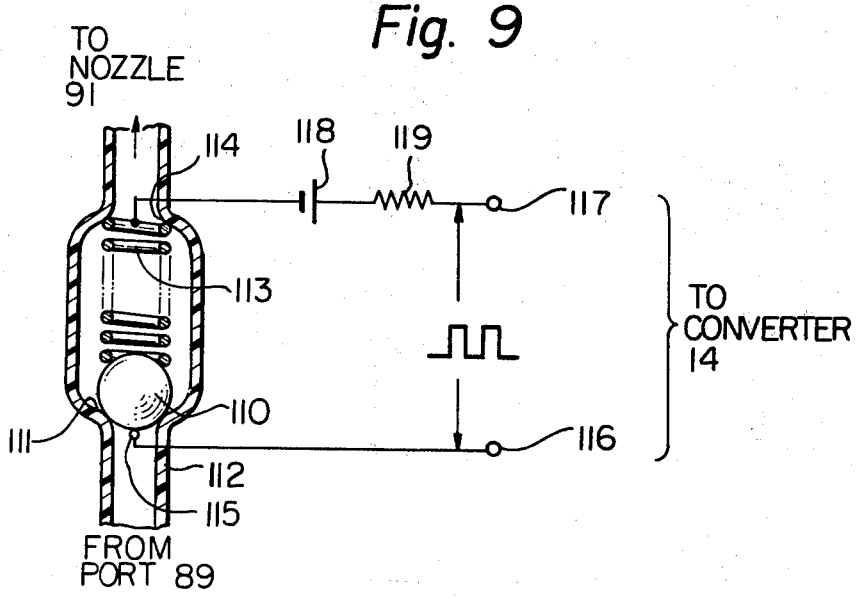
FIG. 9 is a detail of the flow detecting means of FIG. 8.

The flow detecting means 92, as illustrated in detail in FIG. 9, comprises a metal spherical member 110 disposed on a seat 111 formed in a conduit 112 leading from the outlet port 89 of the cylinder 80 to the nozzle 91 and a coil spring 113 disposed between the spherical member 110 and a seat 114 opposite to the seal 111. The ball 110 is urged by the spring 113 to make contact with an electrical contactor as indicated at 115 when there is no passage of fuel to the nozzle, which contactor is connected to an output terminal 116. The coil spring 113 is connected electrically to the positive terminal of a DC voltage source 118, the negative terminal of which is connected by a resistor 119 to a second output terminal 117 so that an electrical circuit is formed between the terminals 116 and 117 and across which a voltage is developed when there is no passage of fuel. Upon the occurrence of a fuel flow in the direction as indicated by the arrow, the ball 110 will be moved in opposition to the spring 113 and disconnect the electrical circuit, so that an electrical pulse will appear across the terminals 116 and 117 in response to each crankshaft rotation.

Figure 10:
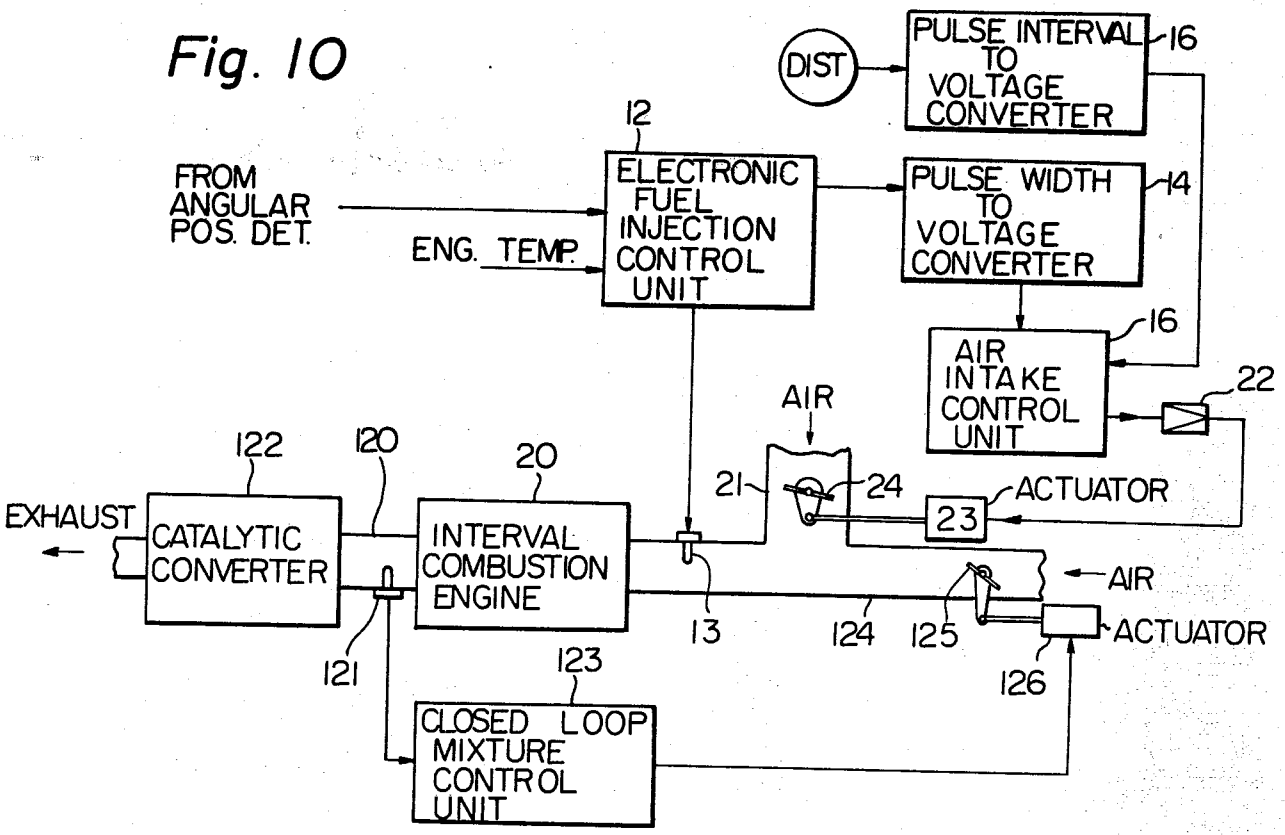
FIG. 10 is a modification of the embodiment of FIG. 1 in which the internal combustion engine is operated under closed loop control mode.

FIG. 10 illustrates another embodiment of the invention in which fuel is controlled in a closed loop operation, and wherein the same numerals are used to indicate parts used in common with the embodiment of FIG. 1. In the exhaust pipe 120 of the engine 20 is disposed an exhaust gas sensor 121 such as zirconia oxygen sensor to be exposed to the exhaust gases to detect the concentration of oxygen in the exhaust gases to provide an electrical signal to represent the air-fuel ratio in the exhaust system. At the downstream of the oxygen sensor 121 is provided a three-way catalytic converter 122 which, when the exhaust gases contain air and fuel in a certain ratio, will promote simultaneously the oxidation of unburned fuel and the reduction of nitrogen oxides. The output from the exhaust gas sensor 121 is supplied to a closed loop mixture control unit 123 which computes the deviation of the air fuel ratio from a ratio near stoichiometry and derives a feedback control signal.

An auxiliary air intake passage 124 is connected to the main intake passage 21 to admit additional air flow into the engine cylinder in response to the output from the closed loop mixture control unit 123. An auxiliary throttle valve 125 is located in the auxiliary intake passage 124 and operatively coupled to an actuator 126 which responds to the output from the control unit 123. The amount of air inducted by way of intake pipes 21 and 124 combined can be controlled by the feedback signal derived from the exhaust gas sensor 121 to correct the ratio of air and fuel supplied to the engine such that the deviation of the air-fuel ratio of the gases in the exhaust pipe 120 from the desired value is minimized, and consequently the three-way catalytic converter operates at a maximum conversion efficiency.

The foregoing description shows only preferred embodiments of the present invention. Various modifications are apparent to those skilled in the art without departing from the scope of the present invention which is only limited by the appended claims. Therefore, the embodiments shown and described are only illustrative, not restrictive.

What is claimed is:

1. A fuel control system for an internal combustion engine including an air intake passage, a throttle valve disposed therein and means for injecting fuel into said intake passage, comprising:

means for detecting the amount of depression by a vehicle occupant of an accelerator pedal;

means for determining the amount of fuel to be injected in response to the detected amount of acceleration and correspondingly operating said fuel injecting means; and means for determining the amount of air to be inducted in response to the determined amount of fuel anc correspondingly operating said throttle valve so that air and fuel are mixed in a predetermined ratio.

2. A fuel control system as claimed in claim 1, wherein said means for determining the amount of air comprises:

means for generating a first signal representative of an engine operating parameter;

means for generating a second signal representative of the determined amount of fuel; and a control unit responsive to said first and second signals for deriving a third signal representative of the opening of said throttle valve.

3. A fuel control system as claimed in claim 2, wherein said control unit comprises:

a memory array having a plurality of memory locations arranged in a matrix configuration, wherein at each of said memory locations there is stored a digital quantity representing a throttle opening for a particular set of engine operating parameter and fuel quantity;

means for converting said first and second signals into digital form;

means for selectively addressing a memory location in response to said converted digital signals; and means for sensing the stored digital quantity in the addressed memory location; and means for converting the sensed digital quantity into analog form to represent said third signal.

4. A fuel control system as claimed in claim 3, wherein said engine operating parameter represents the speed of said engine.

5. A fuel control system as claimed in claim 1, wherein said means for correspondingly operating said throttle valve includes a cylinder having first and second ports, a piston axially slidably disposed in said cylinder and operatively connected at one end to said throttle valve to vary its angular position, a piston head mounted at the other end of the piston for dividing the interior of said cylinder into separate portions, and selectively supplying fluid to one of said separate portions of the cylinder in response to the determined amount of air through said first and second ports.

6. A fuel control system as claimed in claim 1, further comprising:

means for detecting the deviation of the air-fuel ratio in an exhaust system of the engine from a desired value; and means for adjusting the air inducted to said intake passage in response to the direction of the detected deviation of the air-fuel ratio to minimize the amount of said deviation.

7. A fuel control system for an internal combustion engine including an air intake passage, a throttle valve disposed therein and means for injecting fuel into said intake passage, comprising:

means for detecting the amount of depression by a vehicle occupant of an accelerator pedal;

means for determining the amount of fuel to be injected for each revolution of the engine in response to the detected amount of acceleration and correspondingly operating said fuel injecting means;

means for detecting the speed of said engine; and means for determining the amount of air to be inducted for each revolution of the engine in response to the determined amount of fuel and to said detected engine speed such that air and fuel are mixed in a predetermined ratio and correspondingly operating said throttle valve.

* * * * *